US008136745B2

(12) United States Patent
Kaneko

(10) Patent No.: US 8,136,745 B2
(45) Date of Patent: Mar. 20, 2012

(54) METHOD OF MACHINING INJECTION HOLE IN NOZZLE BODY, APPARATUS THEREFORE, AND FUEL INJECTION NOZZLE PRODUCED USING THE METHOD AND APPARATUS

(75) Inventor: Takashi Kaneko, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1268 days.

(21) Appl. No.: 11/822,026

(22) Filed: Jun. 29, 2007

(65) Prior Publication Data

US 2008/0067268 A1 Mar. 20, 2008

(30) Foreign Application Priority Data

Sep. 14, 2006 (JP) ..... 2006-248979

(51) Int. Cl.
*F02M 61/18* (2006.01)
*F02M 61/00* (2006.01)
*B05B 1/14* (2006.01)

(52) U.S. Cl. ..... 239/533.12; 239/533.2; 239/601

(58) Field of Classification Search ..... 239/88–96, 239/533.2–533.12, 601, 559, 567, 584, 585.5
See application file for complete search history.

(56) References Cited

U.S. PATENT DOCUMENTS

| | | | | |
|---|---|---|---|---|
| 4,360,162 | A * | 11/1982 | Eckert | 239/533.4 |
| 5,029,759 | A * | 7/1991 | Weber | 239/533.12 |
| 5,807,163 | A | 9/1998 | Perry | |
| 5,875,973 | A * | 3/1999 | Filiz et al. | 239/533.2 |
| 5,934,571 | A * | 8/1999 | Schmidt et al. | 239/533.9 |
| 6,132,482 | A | 10/2000 | Perry | |
| 6,247,655 | B1 * | 6/2001 | Filiz et al. | 239/533.2 |
| 6,443,374 | B1 * | 9/2002 | Astachow et al. | 239/533.2 |

FOREIGN PATENT DOCUMENTS

| | | | |
|---|---|---|---|
| DE | 20 2006 005 889 | U1 | 7/2006 |
| JP | 7-52022 | A | 2/1995 |
| JP | 9-14087 | A | 1/1997 |
| JP | 9-209876 | A | 8/1997 |
| JP | 10-337649 | A | 12/1998 |
| JP | 11-197946 | A | 7/1999 |
| JP | 11-510437 | A | 9/1999 |
| JP | 2001-347458 | A | 12/2001 |
| JP | 2004-19591 | A | 1/2004 |
| WO | WO 2005/049273 | A1 | 6/2005 |

OTHER PUBLICATIONS

Japanese Office Action issued in Japanese Patent Application No. 2006-248979 on Aug. 30, 2011.

* cited by examiner

*Primary Examiner* — Darren W Gorman
(74) *Attorney, Agent, or Firm* — Birch, Stewart, Kolasch & Birch, LLP

(57) ABSTRACT

The object of the invention is to provide a fuel injection nozzle with which occurrence of cavitation erosion due to occurrence of separation of fuel flow near the needle valve and injection holes is suppressed and variation in fuel injection characteristic is reduced, a method of machining injection holes, and an apparatus therefore to attain the object. An insert tool shaped like the needle valve or an insert tool having a conical surface similar to the needle valve and a groove or grooves are on the conical surface to introduce abrasive fluid to the injection holes, is inserted in the central hollow of the nozzle body when performing abrasive fluid flowing processing to round entrance corners of the injection holes, and the processing of each of the injection holes is stopped when flow rate of abrasive fluid flowing out through relevant injection hole reaches a predetermined value.

2 Claims, 8 Drawing Sheets

(a)

(b)

(a)

(b)

(c)

(a)

(b)

METHOD OF MACHINING INJECTION HOLE IN NOZZLE BODY, APPARATUS THEREFORE, AND FUEL INJECTION NOZZLE PRODUCED USING THE METHOD AND APPARATUS

BACKGROUND OF THE INVENTION

1. Field of the Invention

The present invention relates to a method of machining nozzle holes in a nozzle body composing a fuel injection nozzle for internal combustion engines, an apparatus for machining the nozzle holes, and fuel injection nozzles produced using the method and apparatus.

2. Description of the Related Art

A fuel injection nozzle has been widely used which is composed such that a needle valve is placed for reciprocation in a central hollow of a nozzle body having a plurality of injection holes, and fuel is allowed to be injected through the injection holes provided in the downstream side of the seating position of the needle valve intermittently by allowing the needle valve to be seated on or departs from the seat face. In recent years injection nozzles have been required to improve in fuel atomization in point of view of reduction in fuel consumption, improvement in exhaust gas emission, stability in operation of internal combustion engines.

To improve atomization of injected fuel, it is important to introduce fuel with reduced loss of energy given to fuel to the injection holes and increase velocity of fuel injected through the injection holes, that is, to increase flow rate per injection hole area and per injection pressure, and it is known that rounding of the entrance corners of the injection holes is effective. Rounding of the entrance corners of the injection holes of the nozzle body by flowing abrasive fluid containing abrasive grains through the holes in order to reduce entrance resistance of fuel to the holes has been widely adopted.

One of important problems to be solved in processing of rounding the entrance corners is to even fuel injection characteristic of each of the injection holes. Injection holes are formed by drilling or laser processing beforehand as crude processing in the nozzle body. However, it is usual that there are variations in diameter and burs remaining at the entrance of each of the crude processed holes. And there has been problems that such variations can not be eliminated by abrasive fluid flowing processing and fuel injection characteristic of each injection hole is not evened. When fuel injection characteristic of each of the injection hole is not even, local high temperature zones and fuel rich zones occur in the combustion chamber of the engine resulting in decreased combustion efficiency and deteriorated exhaust emission.

As means to solve such problems, methods of controlling timing of stopping abrasive fluid flowing processing to obtain nozzle bodies having even fuel injection characteristic are discloses in Japanese Laid-Open Patent Application No. 7-52022 (patent literature 1) and Japanese Laid-Open Patent Application No. 9-209876 (patent literature 1). Further, a method of inserting a flow rectifying pipe into the nozzle body to reduce stagnation zone area of abrasive fluid in the forefront space in the nozzle body to a minimum in abrasive fluid flowing processing and make rounding of the entrance corners of the injection holes even.

However, according to the methods disclosed in the patent literature 1 and 2, pressurized abrasive fluid is supplied into the central hollow of the nozzle body without anything inserted into the central hollow. In actual operation of engines, a needle valve is inserted into the central hollow of the injection body, and fuel injection is controlled by allowing the needle valve to be seated on or departed from the seat face in the central hollow of the injection valve. Therefore, flow condition of the abrasive fluid in abrasive fluid flow processing differs largely from actual flow condition of fuel when fuel is injected. As a result, unexpected separation of fuel flow may occur near the needle valve and injection holes in actual operation of engines, occurrence of cavitation erosion is induced, resulting in occurrence of breakage failure in the injection nozzle and uneven fuel injection characteristic.

According to the method disclosed in the patent literature 3, a flow rectifying pipe is inserted into the central hollow in the nozzle body so that the opening at the nose of the rectifying pipe is positioned downstream of the injection holes, and abrasive fluid is flowed between the outer wall of the flow rectifying pipe and the inner wall of the central hollow of the injector body. By this, stagnation zone area of abrasive fluid in the forefront space in the nozzle body and even rounding around the entrance corner of each of the injection holes is realized. However, the flow passage of abrasive fluid is different from the actual flow passage of fuel when fuel is injected in actual operation of engines.

Therefore, flow condition of abrasive fluid in abrasive fluid flow processing is different from actual flow condition of fuel when fuel is injected as is in the methods of the patent literature 1 and 2. As a result, unexpected separation of fuel flow may occur near the needle valve and injection holes, occurrence of cavitation erosion is induced, resulting in occurrence of breakage failure in the injection nozzle and uneven fuel injection characteristic.

Further, the purpose of making injection characteristic of each injection hole even is not attained enough by the methods disclosed in the patent literatures in which timing of stopping abrasion fluid flowing processing is controlled is determined by detecting timing to stop processing.

The patent literature 1 discloses a method in which a flow control device is provided to the outlet side of each of the injection holes and abrasive fluid flowing processing for any one of the injection holes is stopped when flow rate of abrasive fluid through said one hole reaches a predetermined value.

Generally, fuel injection quantity per injection hole (abrasive fluid per injection hole) Q is determined by the flow coefficient μ of injection hole inlet, injection hole area A, pressure difference □P between injection hole inlet and outlet, and further by opening period of the injection hole (abrasive fluid flowing processing period) t and given by the following equation (1).

$$Q \cdot \propto \mu At \square P^{1/2} \quad (1)$$

Pressure difference □P is controlled to be equal for each injection hole. Therefore, to control timing of stopping processing for every injection hole independently so that quantity of abrasive fluid flowed through each injection hole is constant means to control including time (to control so that μA is constant), and μA of an injection hole through which abrasive fluid flowed for a longer time period until flow quantity reaches a determined value is different from that of an injection hole through which abrasive fluid flowed for a shorter time period until flow quantity reaches a determined value. In actual operation of engines, electromagnetic valves control injection time period of each injection nozzle to control engine operation, so a period of time that pressure exerts on each injection hole in a cycle is constant. Therefore, variation in μA induces variation in fuel injection quantity and spray characteristic (atomized fuel particle diameter, spray distribution, etc.)

In the method disclosed in the patent literature 2, the flow meter is located upstream of the nozzle body and flow rate of abrasive fluid flowing through all injection holes of the nozzle body is measured. The processing is stopped when the flow rate reaches a predetermined value. With this method, as flow rate through each individual injection hole can not be controlled, variations in fuel injection characteristic may remain in individual injection holes due to variations in surface roughness and burrs around individual injection holes.

The injection hole machining method disclosed in the patent literature 3 consists of a first step and second step of processing for the purpose of eliminating influence of variation in diameter and surface roughness of injection holes before performing abrasive fluid processing, in the first step abrasive fluid flowing processing being performed under low pressure to even the diameter of each injection hole, and in the second step abrasive fluid flowing processing being performed under higher pressure to round the entrance corner of each of the injection hole. In the first step, diameter of each injection hole is estimated based on measurement result of flow rate of abrasive fluid through each injection hole, and abrasive fluid flow rate is estimated for each injection hole and controlled to obtain target diameter of injection holes. In the second step, abrasive fluid is flowed at the same flow rate for all of the injection holes to round entrance corners of the injection holes. However, with the method, only variation in diameter of injection holes is taken into consideration, variation in surface roughness and small and large of burrs near entrances of injection holes. Therefore, even if variation in diameter of injection holes is eliminated by the processing, there may remain variation in rounding of entrance corners even after the second step of the processing. Further, processing time increases, since the processing is divided in two steps.

SUMMARY OF THE INVENTION

The present invention was made to solve the problems of prior art as mentioned above, and the object of the invention is to provide a fuel injection nozzle with which occurrence of cavitation erosion due to occurrence of separation of fuel flow near the needle valve and injection holes is suppressed and variation in fuel injection characteristic is reduced, a method of machining injection holes and an apparatus therefore to attain the object.

Injection hole machining methods of a nozzle body comprises a step of inserting an insert tool into the central hollow of the nozzle body and retain the insert tool in position, a step of performing abrasive fluid flowing processing by introducing abrasive fluid into the nozzle body to be flowed out through the injection holes while detecting physical value of abrasive fluid flowing through the injection holes, and a step of stopping the processing when physical value of abrasive fluid flowing through the injection holes reaches a predetermined value. The injection hole machining methods of a nozzle body according to some aspects and injection hole machining apparatus according to some aspects of the present invention are characterized as follows:

The method according to the first aspect of the invention is characterized in that an insert tool of which an injection hole side end part is shaped similar to that of the needle valve which is to be inserted in actual operation of engines is inserted into the central hollow of the nozzle body and retained at a position that the needle valve is lifted in actual operation of engines, then abrasive fluid flowing processing is performed.

The method according to the second aspect of the invention is characterized in that an insert tool of which an injection hole side end part is shaped similar to that of the needle valve which is to be inserted in actual operation of engines and the insert tool is retained in a position that the needle valve is lifted in actual operation of engines is used, abrasive fluid is introduced into the nozzle body with its pressure maintained constant when performing abrasive fluid flowing processing, detection of physical value of abrasive fluid flowing through each of the injection holes is done by detecting means provided for each injection hole, and any of the injection holes is blocked when physical value of abrasive fluid flowing through said any of the injection holes reaches a predetermined value. The processing ends when all of the injection holes are blocked.

The method according to the third aspect of the invention is characterized in that an insert tool is used which has a conical surface which can be brought into contact with a conical seat face in the nozzle body and passage grooves dependent of each other of the number the same to that of the injection holes formed on the conical surface of the insert tool, the passage grooves extending along a generation line of the conical surface of the insert tool so that an end of upstream side thereof is communicated with the annular channel communicating to the fuel passage in the nozzle body when the insert tool is inserted into the central hollow of the nozzle body with its rotation position relative to the nozzle body retained at a determined rotation position and with the conical surface thereof being brought into contact with the conical seat face of the nozzle body. Abrasive fluid processing is performed by introducing abrasive fluid into the nozzle body to be flowed through the injection holes with the insert tool retained at the determined position and with pressure of the abrasive fluid maintained at a constant pressure. Physical value of the abrasive fluid flowing out through the injection holes is measured for every injection hole independently by each of detecting means provided at each of injection hole outlet opening sides to measure the physical value of the abrasive fluid flowing out from each of the outlet opening. Any one of the outlet openings is blocked when mass flow rate or volume flow rate of abrasive fluid calculated by relevant one of the detecting means reaches a predetermined value. Abrasive fluid flowing processing ends when all of the injection holes are blocked.

The method according to the fourth aspect of the invention is characterized in that an insert tool is used which has a conical surface which can be brought into contact with a conical seat face in the nozzle body and passage grooves independent of each other of the number the same as that of the injection holes formed on the conical surface, each passage groove having a straight part extending along a generation line of the conical surface and a curved part continuing to the straight part so that an end of upstream side thereof is communicated with an annular channel communicating to a fuel passage in the nozzle body and the other end of downstream side thereof, i.e. downstream side of the curved part of the passage groove is communicated with each of the injection holes when the insert tool is inserted into a central hollow of the nozzle body with its rotation position relative to the nozzle body retained at a determined rotation position and with the conical surface thereof being brought into contact with the conical seat face in the nozzle body. Abrasive fluid flowing processing is performed by introducing abrasive fluid into the nozzle body to be flowed through the injection holes with the insert tool retained at the determined position and with pressure of the abrasive fluid maintained at a constant pressure. Physical value of the abrasive fluid flowed through each of the injection holes is measured for every injection hole independently by each of detecting means provided at each of injection hole outlet opening sides to measure the physical value of the abrasive fluid flowing out from each of the outlet openings. Any one of the outlet openings is blocked when mass flow rate or volume flow rate of abrasive fluid calculated by relevant one of the detecting means reaches a predetermined value. Abrasive fluid flowing processing ends when all of the injection holes are blocked.

The method according to the fifth aspect of the invention is characterized in that an insert tool is used which has a conical surface which can be brought into contact with a conical seat face in the nozzle body and a passage groove formed on the conical surface, the passage groove extending along a generation line of the conical surface so that an end of upstream side thereof is communicated with an annular channel communicating to a fuel passage in the nozzle body and the other end of down stream side thereof is communicated with one of the injection holes when the insert tool is inserted into a central hollow of the nozzle body with its rotation position relative to the nozzle body being retained at a determined rotation position and with the conical surface thereof being brought into contact with the conical seat face in the nozzle body. Abrasive fluid flowing processing is performed by introducing abrasive fluid into the nozzle body to be flowed through the one of the injection holes with the insert tool retained at the determined position and with pressure of the abrasive fluid maintained at a constant pressure. Physical value of the abrasive fluid flowing out through the injection hole is calculated by a detecting means for measuring physical value of the abrasive fluid flowing out from each of the outlet opening. Processing of the one of the injection holes is stopped when mass flow rate or volume flow rate of abrasive fluid flowing out from the outlet opening the injection hole reaches a predetermined value, then the insert tool is rotated so that the passage groove is brought into communication with another one of the injection holes, and processing of the another injection hole is performed in the same way. The processing is repeated until all of the injection holes are processed.

The method according to the sixth aspect of the invention is characterized in that an insert tool is used which has a conical surface which can be brought into contact with a conical seat face in the nozzle body and a passage groove formed on the conical surface, the passage groove having a straight part extending along a generation line of the conical surface and a curved part continuing to the straight part so that an end of upstream side thereof is communicated with an annular channel communicating to a fuel passage in the nozzle body and the other end of downstream side thereof, i.e. downstream side of the curved part of the passage groove is communicated with each of the injection holes when the insert tool is inserted into a central hollow of the nozzle body with its rotation position relative to the nozzle body being retained at a determined rotation position and with the conical surface thereof being brought into contact with the conical seat face in the nozzle body. Abrasive fluid flowing processing is performed by introducing abrasive fluid into the nozzle body to be flowed through the one of the injection holes with the insert tool is retained at the determined position and with pressure of the abrasive fluid maintained at a constant pressure. Physical value of the abrasive fluid flowing out through the injection hole is calculated by a detecting means for measuring physical value of the abrasive fluid flowing out from each of the outlet opening. Processing of the one of the injection holes is stopped when mass flow rate or volume flow rate of abrasive fluid flowing out from the outlet opening the injection hole reaches a predetermined value, then the insert tool is rotated so that the passage groove is brought into communication with another one of the injection holes, and processing of the another injection hole is performed in the same way. The processing is repeated until all of the injection holes are processed.

The apparatus for machining injection holes of a nozzle body according to the seventh aspect of the invention is characterized in that an insert tool is used which has an injection hole side end part shaped to be similar to that of the needle valve and the other end of the insert tool has a flange part so that the insert tool is retained in a position that the needle valve is lifted in actual operation of engines to allow fuel introduced to an annular channel in the nozzle body through a fuel passage in the nozzle body to be injected from the injection holes.

The apparatus according to the eighth aspect of the invention is an apparatus of the seventh aspect wherein processing stopping timing detecting sections are provided which include physical value detectors for detecting physical value of abrasive fluid flowing through each of the injection holes and computing units for calculating mass flow rate or volume flow rate of abrasive fluid flowing out from each of the injection holes, whereby each of the processing stopping timing detecting sections is provided at each of injection hole outlet opening sides.

The apparatus of the ninth aspect of the invention is characterized in that an insert tool is used which has a conical surface similar to that of the needle valve and passage grooves independent of each other of the number the same as that of the injection holes formed on the conical surface, each passage groove extending along a generation line of the conical surface so that an end of upstream side thereof is communicated with an annular channel communicating to a fuel passage in the nozzle body and the other end of down stream side thereof is communicated with each of the injection holes when the insert tool is inserted into a central hollow of the nozzle body with its rotation position relative to the nozzle body being retained at a determined rotation position and with the conical surface thereof being brought into contact with the conical seat face in the nozzle body, and processing stopping timing detecting sections are provided which include physical value detectors for detecting physical value of abrasive fluid flowing through each of the injection holes and computing units for calculating mass flow rate or volume flow rate of abrasive fluid flowing out from each of the injection holes, whereby each of the processing stopping timing detecting sections is provided at each of injection hole outlet opening sides.

The apparatus of the tenth aspect of the invention is characterized in that an insert tool is used which has a conical surface which can be brought into contact with a conical seat face in the nozzle body and passage grooves independent of each other of the number the same as that of the injection holes formed on the conical surface, each passage groove having a straight part extending along a generation line of the conical surface and a curved part continuing to the straight part so that an end of upstream side thereof is communicated with an annular channel communicating to a fuel passage in the nozzle body and the other end of downstream side thereof, i.e. downstream side of said curved part of the passage groove is communicated with each of the injection holes when the insert tool is inserted into a central hollow of the nozzle body with its rotation position relative to the nozzle body being retained at a determined rotation position and with the conical surface thereof being brought into contact with the conical seat face in the nozzle body, and processing stopping timing detecting sections are provided which include physical value detectors for detecting physical value of abrasive fluid flowing through each of the injection holes and computing units for calculating mass flow rate or volume flow rate of abrasive fluid flowing out from each of the injection holes, whereby each of said processing stopping timing detecting sections is provided at each of injection hole outlet opening sides.

The apparatus of the eleventh aspect of the invention is characterized in that an insert tool is used which has a conical surface similar to that of the needle valve and a passage groove formed on the conical surface such that the passage groove extends along a generation line of the conical surface so that an end of upstream side thereof is communicated with an annular channel communicating to a fuel passage in the nozzle body and the other end of down stream side thereof is communicated with one of the injection holes when the insert tool is inserted into a central hollow of the nozzle body with its rotation position relative to the nozzle body being retained at a determined rotation position and with the conical surface thereof being brought into contact with the conical seat face in the nozzle body, a rotating means is provided to an abrasive fluid container or to a mounting platform for securing the nozzle body so that the rotating means can rotate the insert tool about its central axis or rotate the mounting platform about the central axis of the supply passage of the container for supplying abrasive fluid to the fuel passage of the nozzle body by a determined rotation angle, and said processing stopping timing detecting section includes a physical value detector for detecting physical value of abrasive fluid flowing through any of the injection holes and a computing unit for calculating mass flow rate or volume flow rate of abrasive fluid flowing out from relevant injection hole.

The apparatus according to the twelfth aspect of the invention is characterized in that an insert tool is used which has a conical surface similar to that of the needle valve and a passage groove formed on the conical surface, the passage groove having a straight part extending along a generation line of the conical surface and a curved part continuing to the straight part so that an end of upstream side thereof is communicated with an annular channel communicating to a fuel passage in the nozzle body and the other end of downstream side thereof, i.e. downstream side of said curved part of the passage groove is communicated with each of the injection holes when the insert tool is inserted into a central hollow of the nozzle body with its rotation position relative to the nozzle body being retained at a determined rotation position and with the conical surface thereof being brought into contact with the conical seat face in the nozzle body, a rotating means is provided to an abrasive fluid container or to a mounting platform for securing the nozzle body so that the rotating means can rotate the insert tool about its central axis or rotate the mounting platform about the central axis of the supply passage of the container for supplying abrasive fluid to the fuel passage of the nozzle body by a determined rotation angle, and said processing stopping timing detecting section includes a physical value detector for detecting physical value of abrasive fluid flowing through any of the injection holes and a computing unit for calculating mass flow rate or volume flow rate of abrasive fluid flowing out from relevant injection hole.

The fuel injection nozzle of the thirteenth through fifteenth aspects of the invention have following features:

The fuel injection nozzle according to the thirteenth aspect of the invention has a nozzle body having injection holes each of which has an entrance corner rounded with a larger curvature radius in its upstream region of fuel flow than that in other than the upstream region of fuel flow.

The fuel injection nozzle according to the fourteenth aspect of the invention has a nozzle body having concave portions of very small depth on its conical seat face, the concave portions being formed to extend along generation lines of the conical seat face by abrasive fluid flowing processing using the apparatus of the eleventh aspect of the invention.

The fuel injection nozzle according to the fifteenth aspect of the invention has a nozzle body having concave portions of very small depth formed on its conical seat face by abrasive fluid flowing processing, the number of the concave portions being the same as that of the injection holes, each of the concave portions consisting of a straight part extending along generation lines of the conical seat face in the nozzle body and a curved part continuing to the straight part, and the entrance corner of each injection hole is rounded with a larger curvature radius in a region continuing to the concave portion than in regions other than the region continuing to the concave portion.

DETAILED DESCRIPTION OF THE INVENTION

Preferred embodiments of the present invention will now be detailed with reference to FIGS. 1 to 8. The invention shall not be limited to the embodiments described hereafter, it is recognized that variations and changes may be made therein without departing from the invention as set forth in the claims of the invention.

The First Embodiment

Figure 1:
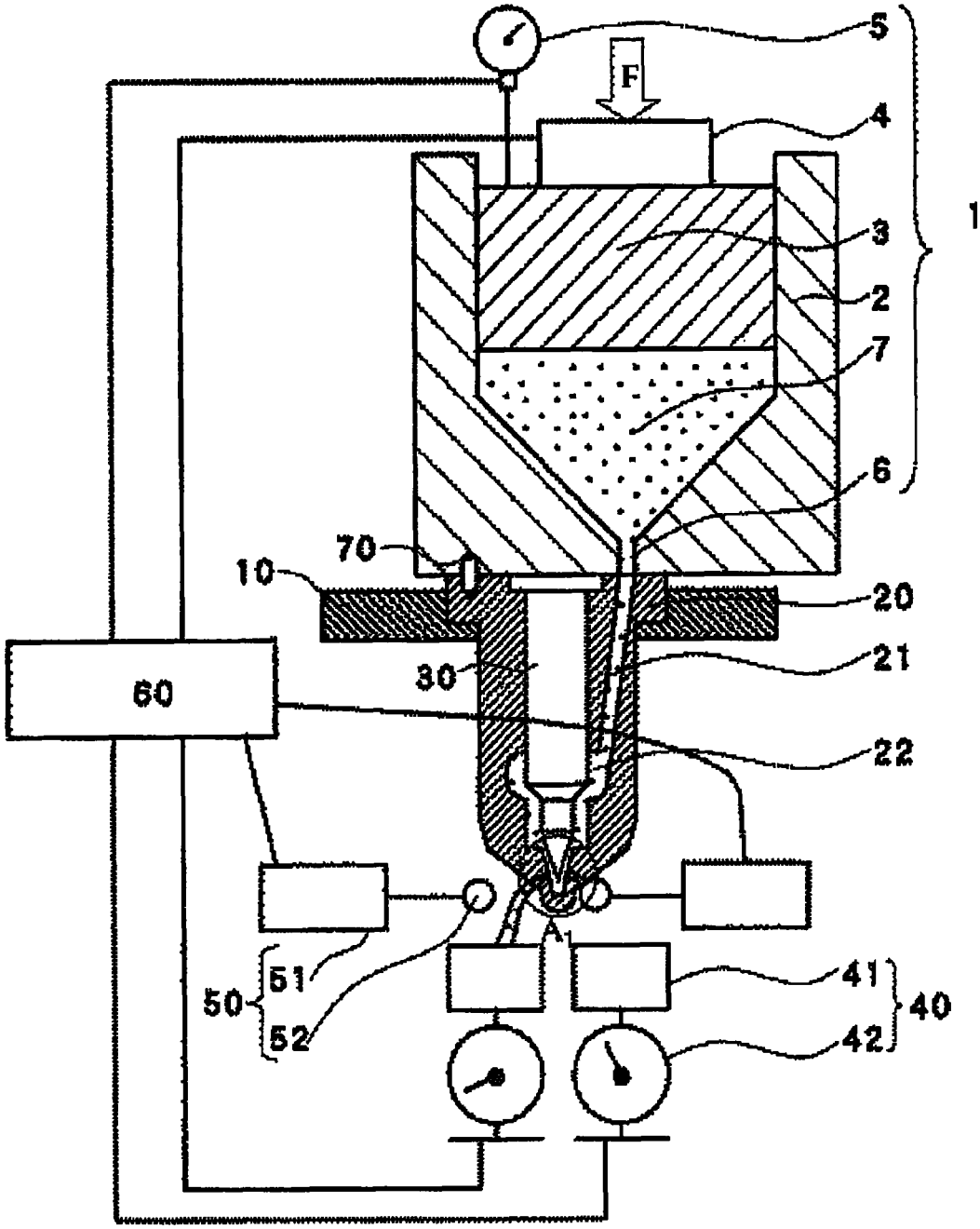
FIG. 1 is a schematic representation of an apparatus for machining injection holes of a nozzle body in the first and second embodiments.
Figure 2:
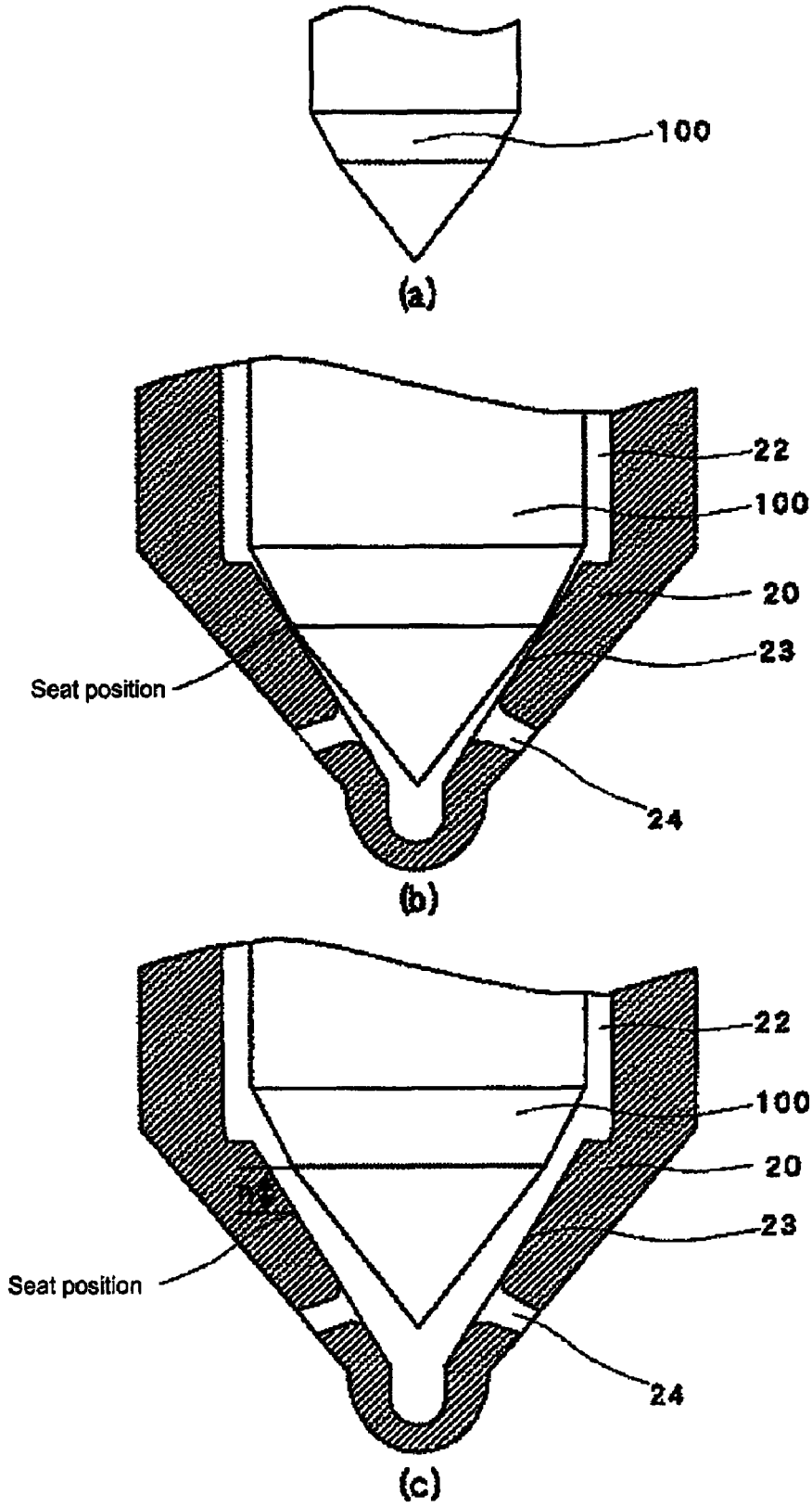
FIG. 2*a* is a view showing general shape of the forefront part of a needle valve.
FIG. 2*b* is a sectional view showing positional relation between the needle valve and nozzle body at the forefront part thereof when the injection holes are closed.
FIG. 2*c* is a view as in FIG. 2*b* when the injection holes are opened.
Figure 3:
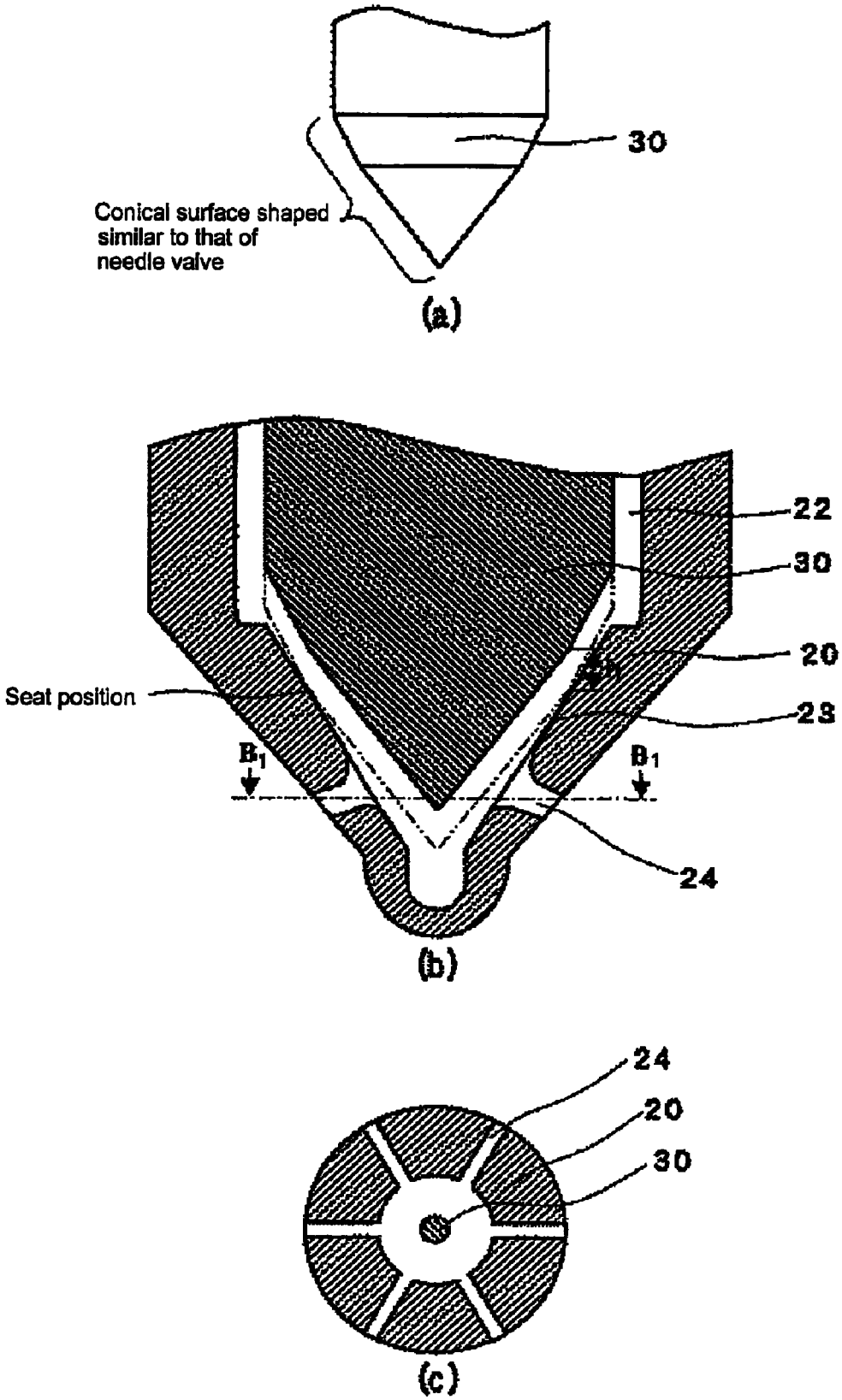
FIG. 3*a* is a view showing the shape of the forefront part of the insert tool used in the first embodiment.
FIG. 3*b* is an enlarged sectional view of a part $A_1$ in FIG. 1 near injection holes.
FIG. 3*c* is a section along line $B_1$-$B_1$ in FIG. 3*b*.
Figure 4:
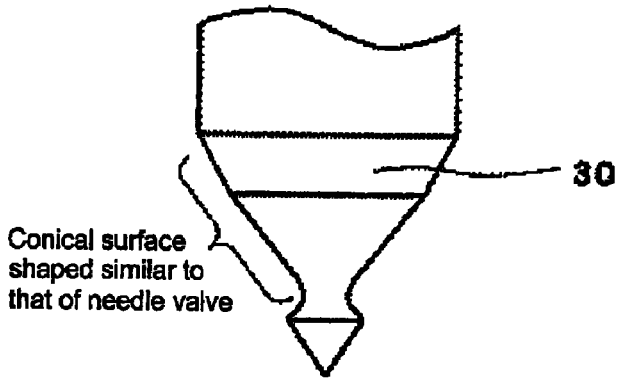
FIG. 4*a* is a view showing the shape of the forefront part of the insert tool having a spacer part used in the first embodiment.
FIG. 4*b* is an enlarged sectional view of a part $A_1$ in FIG. 1 near injection holes.
FIG. 4*c* is a section along line $B_2$-$B_2$ in FIG. 4*b*.
Figure 4:
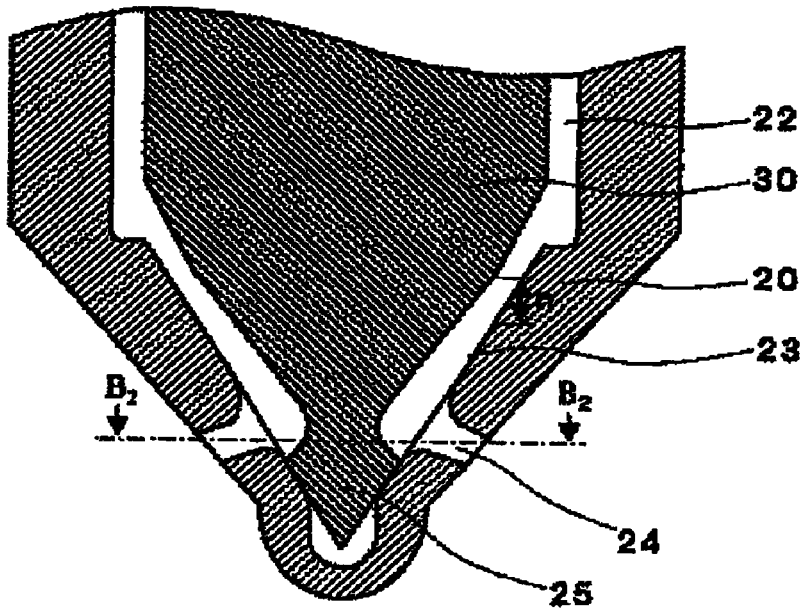
Figure 4:
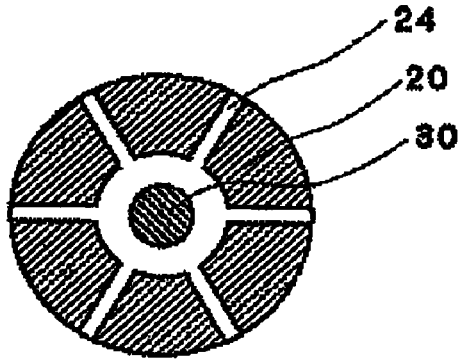
Figure 5:
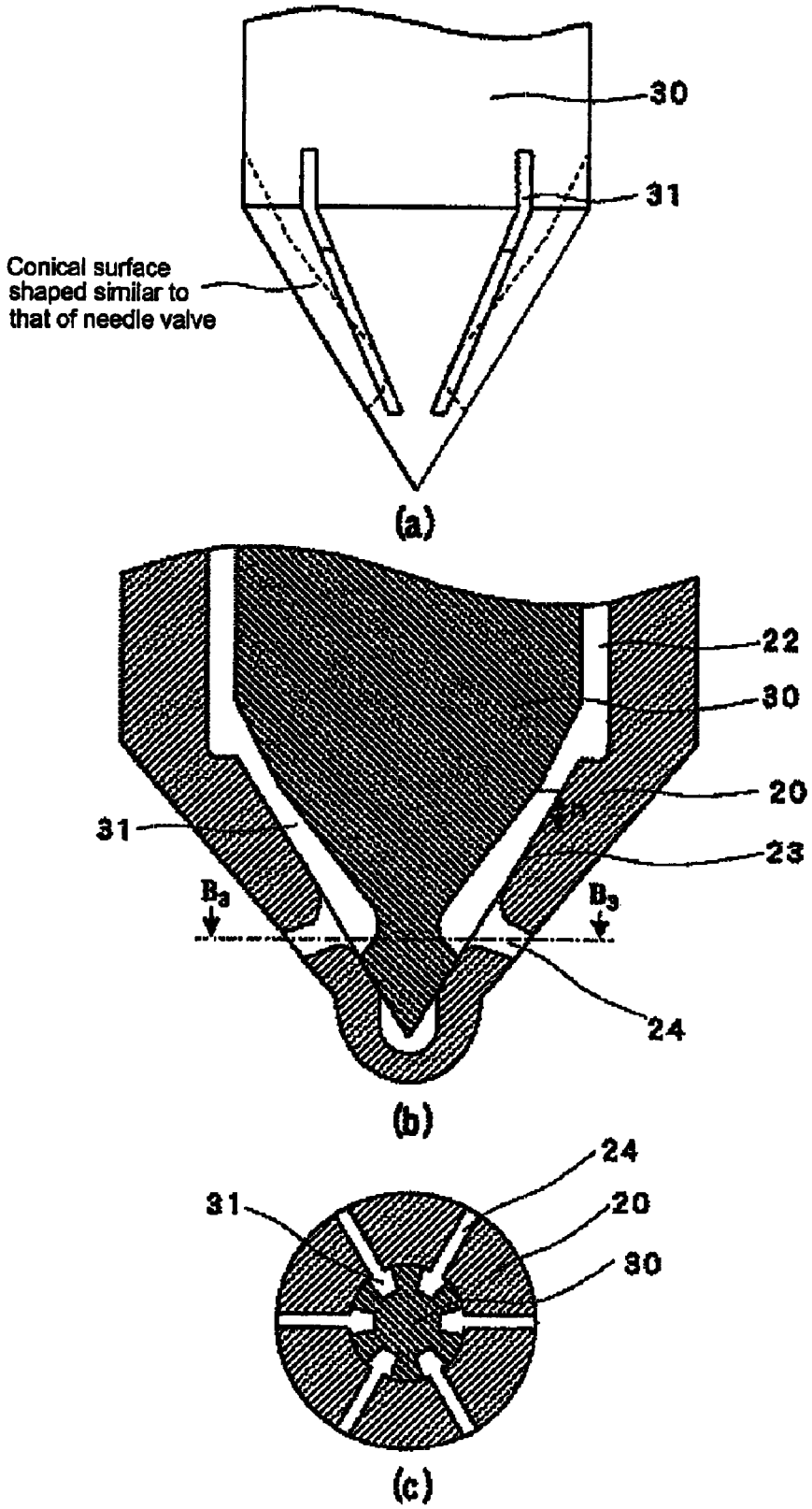
FIG. 5*a* is a view showing the shape of the forefront part of the insert tool used in the second embodiment.
FIG. 5*b* is an enlarged sectional view of a part $A_1$ in FIG. 1 near injection holes.
FIG. 5*c* is a section along line $B_3$-$B_3$ in FIG. 5*b*.

First, the first embodiment of the invention will be explained referring to FIGS. 1 to 4. FIG. 1 is a schematic representation of an apparatus for machining injection holes of a nozzle body in the first embodiment.

The apparatus comprised mainly of an abrasive fluid supply section 1, a mounting platform 10, a nozzle body 20 to be processed, an insert tool 30 for abrasive fluid flowing processing, processing end detection sections 40, flow blocking sections 50, and a controller 60.

The abrasive fluid supply section 1 is composed of a barrel 2, a piston 3, a load detector 4, a displacement detector 5, and a piston drive device not shown in the drawing. The barrel 2 has an inside space in which abrasive fluid 7 is contained. A passage 6 for the abrasive fluid to flow through that has a diameter approximately as same as a diameter of fuel passage 21 of the nozzle body to be processed, is provided at the lower end of the inside space of the barrel 2. The piston 3 is placed in the inside space of the barrel 2 slidable with a small clearance to seal the abrasive fluid in the inner space. Driving force F is applied to the piston 3 by the piston drive device to push out the abrasive fluid 7 in the barrel 2 through the passage 6.

The load detector 4 and displacement detector 5 are provided to the piston 3. The load detector 4 serves to monitor so that pressure of abrasive fluid is maintained constant during abrasive fluid flowing processing and the displacement detector 5 serves to monitor piston displacement so that flow rate of abrasive fluid is calculated. The two detectors are connected to the controller 60 and to the piston drive device not shown in the drawing for closed-loop controlling.

The controller 60 controls so that pressure of abrasive fluid calculated by the two detectors is maintained constant.

The nozzle body 20 to be processed has a central hollow for accommodating a needle valve, and a tapered seat face 23 is formed in the central hollow at its forefront part. Six injection holes 24 are located at equal spacing in circumferential direction on the seat face 23. The six injection holes are drilled or formed by laser processing to communicate the central hollow with the outside of the nozzle body 20 beforehand. The nozzle body 20 has a fuel passage 21 extending from the rear end thereof to an annular space 22 provided in the central hollow at a central part thereof so that fuel is introduced from the annular space 22 to the injection holes 24 to be injected there through.

The nozzle body 20 is fixed to the mounting platform 10 by means not shown in the drawing, the insert tool 30 is inserted into the central hollow of the nozzle body 20, and the insert tool 30 is retained in position for abrasive fluid flowing processing.

Here, before explaining the insert tool used in abrasive fluid flowing processing of the first embodiment, opening and closing of a fuel injection nozzle will be explained briefly. FIG. 2*a* is a view showing general shape of the forefront part of a needle valve, FIG. 2*b* is a sectional view showing positional relation between the needle valve and the nozzle body at the forefront part thereof when the injection holes are closed, and FIG. 2*c* is a view as in FIG. 2*b* when the injection holes are opened.

In this specification, the fuel injection nozzle means a combination of a nozzle body and a needle valve. A needle valve 100 having a two-stage-tapered pointed end part as shown in FIG. 2*a* or having a one-stage-tapered pointed end part not shown in the drawing is widely used. When the pointed end part of the needle valve 100 is seated on the seat face in the central hollow of the nozzle body 20, the injection holes are closed and fuel is not injected. In this state, the salient boundary between the two tapered surfaces of the needle valve 100 is seated on the seat face 23 of the nozzle body 20 and fuel is interrupted from flowing to the injection holes. Through this seated part seems as if the salient boundary is brought into line contact with the seat face, actually they are brought into face contact due to elastic deformation of the contacting part of the needle valve 100 with nozzle body 20. When the needle valve 100 is lifted in its axial direction as shown in FIG. 2*c*, fuel flows through the annular aperture resulted between the lifted needle valve 100 and nozzle body 20 to the injection holes 24. The maximum lift of the needle valve is usually predetermined, it is possible to compose such that needle valve lift is variable continuously or stepwise according to engine operation conditions.

The insert tool 30 is inserted into the central hollow of the nozzle body 20 for the purpose of performing abrasive fluid flowing processing under a condition of actual fuel flow as shown in FIG. 2*c*. How the insert tool is utilized for the purpose will be explained hereafter.

FIG. 3*a* is a view showing the shape of the forefront part of the insert tool used in the first embodiment, FIG. 3*b* is an enlarged sectional view of a part $A_1$ in FIG. 1 near injection holes, and FIG. 3*c* is a section along line $B_1$-$B_1$ in FIG. 3*b*.

An insert tool 30 having a pointed end part similar in shape to the needle valve 100 as shown in FIG. 3*a* is used when performing abrasive fluid flowing processing of the injection holes of the nozzle body 20. A pointed end part similar in shape to the needle valve 100 means that an annular passage formed between the pointed end part of the insert tool, i.e. conical surface of the insert tool 30 and the conical seat face inside the nozzle body facing the conical surface of the insert tool 30 when the insert tool 30 is retained in position for abrasive fluid flowing processing is similar to that formed from near the seat portion to near the injection holes when the needle valve 100 is lifted in actual operation of engines. Therefore, the conical surface of the insert tool may be formed in the same shape as that of the needle valve 100 or formed in the shape as shown in FIG. 4*a*. The insert tool is preferably made of abrasion resistant material in consideration of abrasion by abrasive grains contained in abrasive fluid.

The insert tool 30 is inserted into the central hollow of the nozzle body 20 such that the central axis of the insert tool coincides with that of the central hollow of the nozzle body 20 and the insert tool 30 is retained at a position at which the seat part of the conical surface of the insert tool departs from the conical seat face in the nozzle body 20 by a height of h along the central axis. The height h may be the maximum lift of the needle valve 100 in engine operation or smaller, however, it is more preferable that the height h is a half lift (half of the maximum lift of the needle valve 100) in point of view of reducing processing period. In FIG. 3*b*, the chain line represents the profile of the conical surface of the insert tool 30 when its seat part is seated on the conical seat face in the nozzle body 20. In this case, abrasive fluid flowing processing is performed with the insert tool having the conical surface the same in shape to that of the needle valve 100 being retained at the maximum lift position of the needle valve. In this way, abrasive fluid flowing processing can be performed with the passage for abrasive fluid to be flowed being simulative of the actual fuel passage.

By retaining the insert tool 30 in position, conical annular channel is formed and the abrasive fluid can flow through the passage space surrounding the conical surface of the insert tool 30 to be introduced to the injection holes 24 as shown in FIG. 3*c*. Therefore, as to adjusting of position of the insert 30, only adjusting height position of the insert tool 30 is needed regardless of rotation position of the insert tool 30 relative to the nozzle body 20. The insert tool 30 can be retained in position by providing a flange part at the upper end thereof, for example, as shown in FIG. 1. It is also possible to provide an insert tool retaining mechanism comprising an actuator and controller not shown in the drawing in order to fine-adjust axial positioning of the insert tool.

Another adjusting means of axial position of the insert tool 30 is shown in FIGS. 4*a* and 4*b* in which the insert tool 30 is shaped to have a conical surface of a spacer part 25 as a pointed end part to contact the lower end part of the conical seat face in the nozzle body 20. In this case, positioning of the insert tool is done by the contact of the spacer part 25 to the conical seat face in the nozzle body 20. In this case, as the spacer part 25 is positioned at a position lower the injection holes 24, the fluid passage upstream from the injection holes 24 can be formed in a shape similar to the actual fuel passage in engine operation.

As mentioned above, the insert tool 30 is inserted into the central hollow of the nozzle body 20, the insert tool 30 is retained in position, then the barrel 2 is attached so that the abrasive fluid flow passage 6 of the barrel 2 is communicated with the fuel passage 21 of the nozzle body 20, and the barrel 2 is fixed to the nozzle body concerning rotation position by a dowel pin 70. The abrasive fluid 7 in the barrel 2 pushed out by moving down the piston 3 through the flow passage 6 to the fuel passage 21 of the nozzle body 20 and introduced to the nozzle holes 24 through the annular channel 22 between the cylindrical part of the central hollow of the nozzle body and the cylindrical part of the insert tool and through the conical annular channel between the conical seat face 23 and the conical surface shaped similar to the conical surface of the needle valve 100.

As abrasive grains, silicon carbide, aluminum oxide, diamond, etc. may be used as has been used conventionally, and grain size is selected in accordance with the targeted diameter of injection hole. As to the medium for carrying abrasive grains, it is preferable to select a fluid having viscosity characteristic similar to that of fuel actually used so that abrasive fluid flowing processing is performed in a flow condition similar to that in the actual fuel flow when the abrasive fluid is flowed under pressure under which the abrasive fluid flow becomes a turbulent flow.

Each of the processing end detection sections 40 includes an abrasive fluid receiver 41, a load detector 42, and a computing unit not shown in the drawing. Each of the processing end detection section 40 is provided at the outlet side of each of the injection holes 24 so that weight of abrasive fluid passed through each injection hole can be measured independently. The detected weight of the abrasive fluid detected by the load detector 42 is inputted to the computing unit. Each of the computing unit sends a signal to the controller 60 when the mass flow rate of the abrasive fluid computed by each computing unit reaches a predetermined value, and the controller 60 connected to each load detector 42 sends a demand signal to each flow blocking section 50.

Each of the flow blocking sections 50 includes an air cylinder 51 and a blocking member 52 and provided near the outlet of each injection hole 24. The flow blocking sections 50 are connected to the controller 60. The air cylinder 51 pushes the blocking member 52 to block the outlet opening of a relevant injection hole upon receiving demand signal from the controller 60 to stop abrasive fluid flowing processing of the relevant injection hole. At the same time, the controller controls to reduce downward moving velocity of the piston so that pressure of the abrasive fluid in the barrel 2 is maintained constant. Abrasive fluid flowing processing ends when all of the holes are blocked.

The processing end detection sections 40 provided at the outlet side of each of the injection holes 24 use the load detectors 42 for detecting flow rate of abrasive fluid flowing out through each of the injection holes 24 in the embodiment, flow meters of any type which can measure flow rate of abrasive fluid flowing out through the each of the injection holes may be used. Any devices that can measure weight or volume per unit time of abrasive fluid flowing out through each of the injection holes can be adopted.

A nozzle body processed by the method and apparatus of the embodiment will have injection holes of which the entrance corner of each hole is rounded with a larger curvature radius in the upstream side of fuel in actual operation of engines than in the entrance corner other than the upstream side, because the sectional area of conical flow passage is reduced from the seat part toward the injection holes and the abrasive fluid flow is flexed larger at the entrance corner of upstream side as compared with the case the insert tool is not inserted into the central hollow of the nozzle body. When fuel is injected through the holes in actual operation of engines, a large part of fuel flows into the injection holes via the upstream side entrance corner of the holes, so the nozzle body with injection holes rounded with a larger curvature radius in the upstream side entrance corner where resistance for the flow entering the injection hole is particularly large is advantageous for fuel atomization and occurrence of cavitation erosion is reduced. Further, as abrasive fluid flowing processing for each injection hole is stopped independently when flow rate in weight or volume of abrasive fluid through the relevant injection hole reaches a predetermined rate, fuel atomization characteristic of each injection hole is evened.

The Second Embodiment

Next, the second embodiment will be explained. In this embodiment, procedure in abrasion fluid processing in the second embodiment is the same as that in the first embodiment, an insert tool 30 different in shape from the insert tool 30 in the first embodiment is used in the second embodiment, because the insert tool in the second embodiment must be fixed in rotation position relative to the nozzle body. The injection hole processing apparatus shown in FIG. 1 can be used for performing the second embodiment of the abrasion fluid processing.

FIG. 5*a* is a view showing the shape of the forefront part of the insert tool used in the second embodiment, FIG. 5*b* is an enlarged sectional view of a part $A_1$ in FIG. 1 near injection holes, and FIG. 5*c* is a section along line $B_3$-$B_3$ in FIG. 5*b*.

As shown in FIG. 5*a*, the insert tool 30 used in the embodiment has a conical end part to be seated on the conical seat face 23 in the nozzle body, and a plurality of passage grooves 31 are formed independently of each other on the conical surface of the insert tool 30, the number of the grooves being the same as that of the injection holes. Each of the grooves 31 extends along a generation line of the conical surface of the insert tool so that the annular channel 22 is communicated with each of the injection holes 24 via each of the passage grooves 31. The conical surface of the insert tool 30 is formed similar to that of the needle valve 100 and the depth of each of the passage grooves 31 from the conical surface is about the same to maximum height of lift of the needle valve 100 in actual operation of engines.

Therefore, as shown in FIG. 5*b*, by inserting the insert tool 30 into the nozzle body 20 so that the conical surface of the insert tool contacts the conical seat face in the nozzle body 20 and rotation position of the insert tool is retained so that the lower end part of each of the passage grooves 31 is communicated with each of the injection holes 24, abrasive fluid flows through each of the passage groove 31 of which the upper end is communicated with the annular channel 22 and through each of the injection holes 24. In the embodiment, the injection holes 24 are provided at equal spacing in circumferential direction, the passage grooves 31 are also provided at equal spacing in circumferential direction. When inserting the insert tool 30, axial position of the insert tool 30 is determined by the contact of the conical surface of the insert tool and the conical seat face in the nozzle body 20, and only rotation position of the insert tool 30 is needed to be adjusted.

The width of each passage groove 31 preferably wider than the diameter of injection hole 24 so that rounding of the entrance corner of the injection hole 24 is affected all around the corner by abrasive fluid flowing through the injection hole 24. It is also preferable that the passage grooves 31 extend below the lower side entrance corner of the injection holes 24 when the insert tool 30 is in position.

By supplying abrasive fluid through the fuel passage 21 of the nozzle body 20 with pressure of the abrasive fluid 7 maintained at a constant pressure as is in the first embodiment, the abrasive fluid flows to the injection holes 24 via the annular channel 22 and the passage grooves 31 with the insert tool 30 retained in position, and abrasive fluid flowing processing of the injection holes is performed in the same way as in the first embodiment. Stopping of the processing of each of the injection holes 24 is done in the same way as in the first embodiment.

A nozzle body processed by the method and apparatus of the embodiment will have injection holes of which the entrance corner of each injection hole is rounded with a larger curvature radius in the upstream side than in the entrance corner other than the upstream side, because abrasive fluid flows only through the passage grooves 31 extending along the along the generation lines of the conical surface, so the abrasive fluid flows into each injection hole 24 concentrically from the entrance thereof and the flow is flexed large at the upstream side corner of the entrance of the injection hole. When fuel is injected through the holes in actual operation of engines, a large part of fuel flows into the injection holes via the upstream side entrance corner rounded with a larger curvature radius where resistance for the flow entering the injection holes is particularly large, so the nozzle body with injection holes rounded with a larger curvature radius in the upstream side corner than in the downstream side corner is advantageous for fuel atomization and occurrence of cavitation erosion is reduced. Further, as abrasive fluid flowing processing for each injection hole is stopped independently when flow rate in weight or volume of abrasive fluid through the relevant injection hole reaches a predetermined rate, fuel atomization characteristic of each injection hole is evened.

Further, as abrasive fluid flows through the straight passage grooves 31, concave portions of very small depth not shown in the drawings are formed in the conical seat face 23 in the nozzle body 20 extending downstream along generation lines of the conical seat face to the injection holes 24. That is, the concave portions are formed to reach the injection holes 24 by the most direct way. Therefore, in actual operation of engines, fuel flows to the injection holes 24 easier taking the shortest way, and it is advantageous for increased fuel flow through the injection holes 24.

When the needle valve 100 is inserted into the central hollow of the nozzle body processed by the method and apparatus of the embodiment in actual operation of engines, fuel leak through the concave portions when the needle valve 100 is seated on the conical seat face 23 is prevented by designing so that proper elastic deformation occurs in the seating portion of the conical surface of the needle on the conical seat face in the nozzle body.

The Third Embodiment

Next, the third embodiment will be explained. This embodiment differs from the first and second embodiments in that the insert tool is differently shaped and that abrasive fluid flowing processing of one injection hole is performed at a time.

Figure 6:
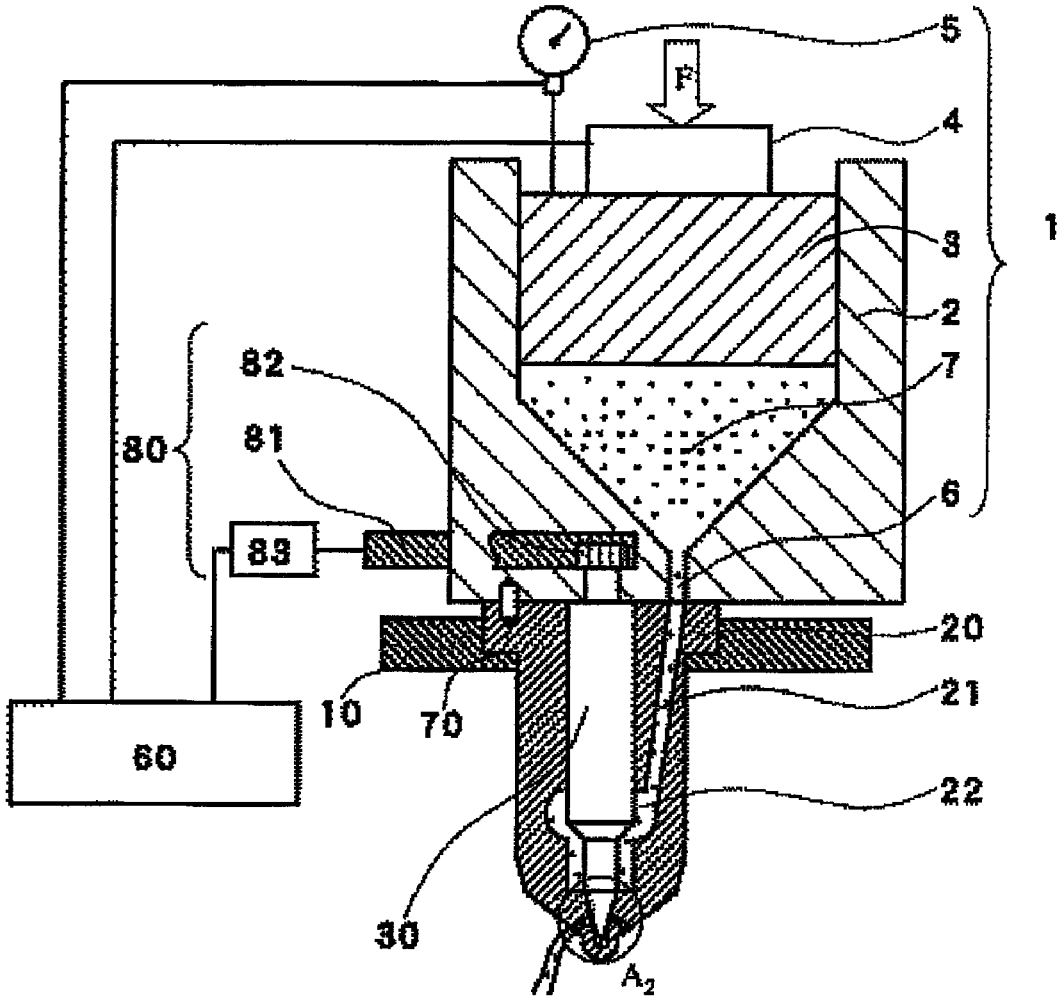
FIG. 6 is a schematic representation of an apparatus for machining injection holes of a nozzle body in the third embodiment.
Figure 7:
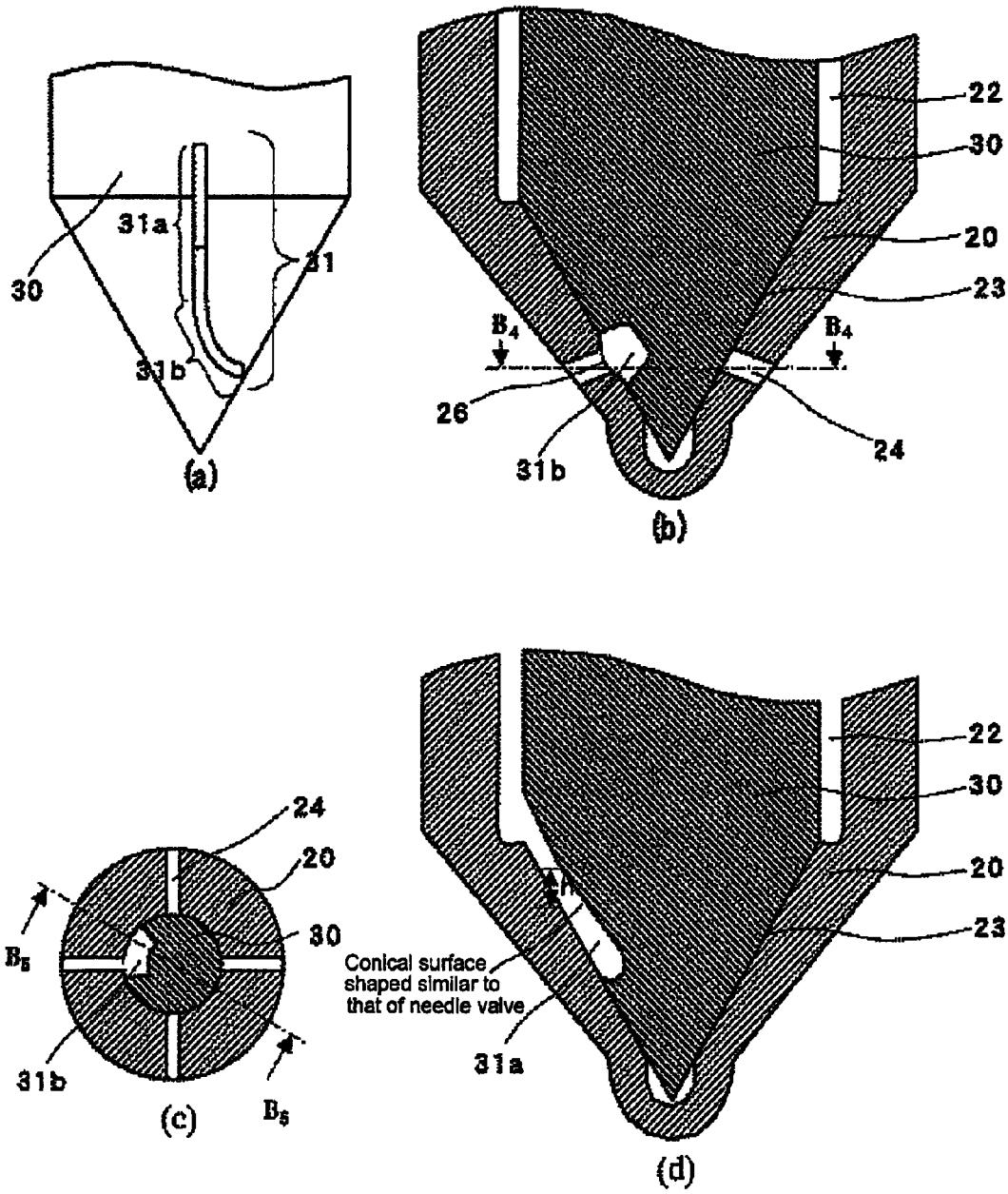
FIG. 7*a* is a view showing the shape of the forefront part of the insert tool used in the third embodiment.
FIG. 7*b* is an enlarged sectional view of a part $A_2$ in FIG. 6 near injection holes when sectioned by a plane containing the central axis of an injection hole and the central axis of the insert tool.
FIG. 7*c* is a section along line $B_4$-$B_4$ in FIG. 7*b*.
FIG. 7*d* is a sectional view when sectioned by a containing the center line of the straight part of a passage groove and the central axis of the insert tool (section along line $B_5$-$B_5$ in FIG. 7*c*).
Figure 8:
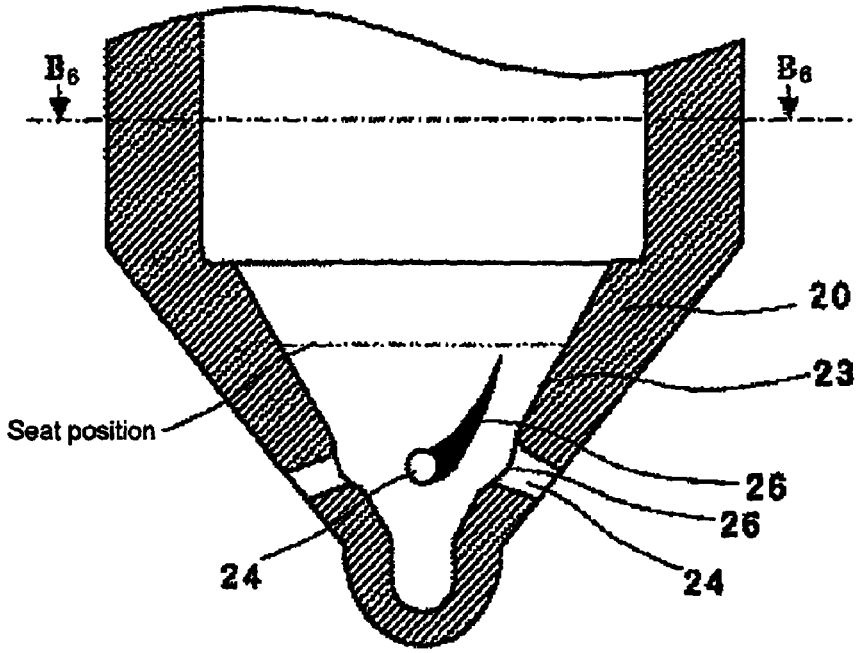
FIG. 8*a* is a sectional view of the forefront part (part near the injection holes) of the nozzle body processed by the processing method of the third embodiment.
FIG. 8*b* is a section along line $B_6$-$B_6$ in FIG. 8*a*.
Figure 8:
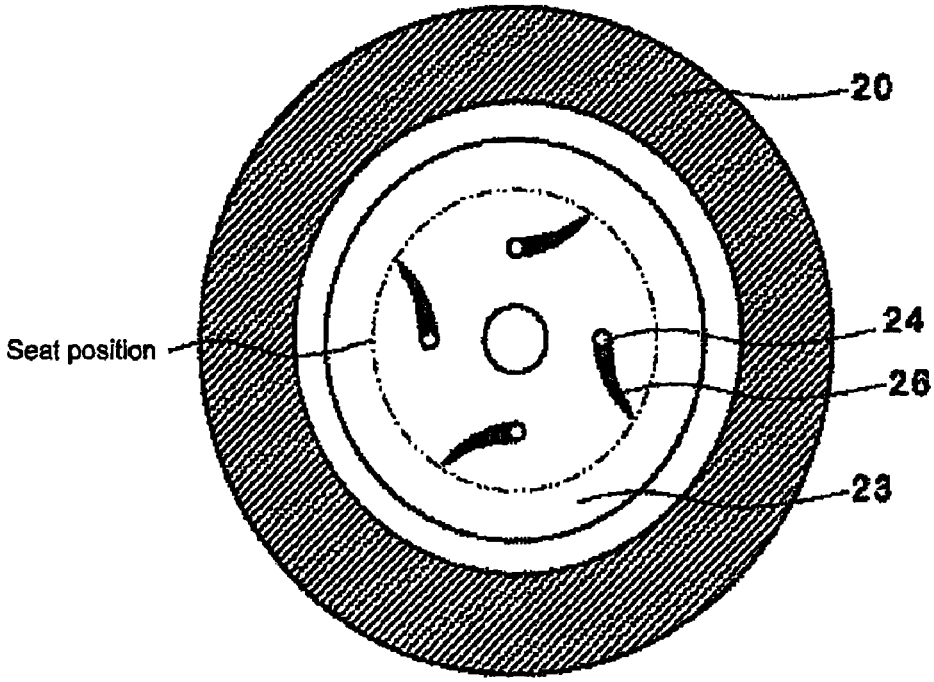

FIG. 6 is a schematic representation of an apparatus for machining injection holes of a nozzle body in the third embodiment. FIG. 7*a* is a view showing the shape of the forefront part of the insert tool used in the third embodiment, FIG. 7*b* is an enlarged sectional view of a part $A_2$ in FIG. 6 near injection holes when sectioned by a plane containing the central axis of an injection hole and the central axis of the insert tool, FIG. 7*c* is a section along line $B_4$-$B_4$ in FIG. 7*b*, and FIG. 7*d* is a sectional view when sectioned by a containing the center line of the straight part of a passage groove and the central axis of the insert tool (section along line $B_5$-$B_5$ in FIG. 7*c*).

As shown in FIG. 7*a*, the insert tool 30 used in the embodiment has a conical surface to be seated on the conical seat face 23 in the nozzle body, and a passage groove 31 are formed on the conical surface of the insert tool 30. The groove 31 consists of a straight part 31*a* extending along a generation line of the conical surface of the insert tool and a curved part 31*b* succeeding to the straight part 31*a*. The conical surface of the insert tool is formed similar to that of the needle valve 100 and the depth of the passage groove 31 from the conical surface is about the same to maximum height of lift of the needle valve 100.

As shown in FIG. 7*b*, FIG. 7*c*, and FIG. 7*d*, by inserting the insert tool 30 into the nozzle body 20 so that the conical surface thereof contacts the conical seat face in the nozzle body 20 and rotation position thereof is retained so that the lower end part of the passage grooves 31 is communicated with one of the injection holes 24, abrasive fluid flows through the passage groove 31 of which the upper end is communicated with the annular channel 22 and through the relevant injection hole 24. When inserting the insert tool 30, axial position of the insert tool 30 is determined by the contact of the conical surface of the insert tool and the conical seat face in the nozzle body 20, and only rotation position of the insert tool 30 is needed to be adjusted.

Abrasive fluid flowing processing is performed by supplying the abrasive fluid 7 in the barrel 2 with pressure maintained at a constant pressure to the nozzle body 20 in the same way as in the first and second embodiment.

In the embodiment, when volume flow rate of abrasive fluid calculated from displacement of the piston 3 detected by the displacement detector 5 reaches a predetermined value to stop abrasive fluid flowing processing, the controller 60 connected to the displacement detector 5 sends a demand signal to the piston 3 to stop its actuation. The load detector 4 and displacement detector 5 serve respectively as a monitoring sensor for maintaining pressure of abrasive fluid constant and a monitor sensor for determining timing of stopping abrasive fluid flowing processing. It is suitable of course to provide a processing end detection section separately as in the first and second embodiment.

When processing of one of the injection holes is finished, the insert tool 30 is rotated by a rotating means 80 so that the lower end part of the curved part of the passage groove 31 is brought into communication with one of other unprocessed injection holes and abrasive fluid flowing processing is performed for the injection hole. This process is repeated until all of the injection holes are processed.

The rotating device 80 includes a rack 81, a pinion 82, and a linear motor 83. The linear motor 83 is connected to the controller 60. The linear motor 83 shifts the rack 81, which is provided to the barrel 2 so that the rack 81 does not interfere the abrasive fluid in the barrel 2, by a predetermined distance in a determined direction upon recognizing a demand signal to shift the rack 81 sent from the controller 60. The pinion 82 is fixed to the upper end of the insert tool 30 and engaged with the rack 81, so the insert tool 30 is rotated by the circumferential angle between the injection holes so that the next injection hole to be processed is communicated with the passage groove 31 by shifting the rack 81 by the predetermined distance. When the injection holes are not formed at equal spacing to each other, shifting distance is determined in accordance with each circumferential pitch of the injection holes.

In the embodiment, although insert tool 30 is rotated, it is possible to compose such that the mounting platform 10 to which the nozzle body 20 is fixed is rotated about the central axis of the passage 6 of the barrel 2.

FIG. 8*a* is a sectional view of the forefront part (part near the injection holes) of the nozzle body processed by the processing method of the third embodiment, and FIG. 8*b* is a section along line $B_6$-$B_6$ in FIG. 8*a*. A broken line in FIG. 8*a* indicate the seat position, the fuel injection nozzle is closed or opened when the needle valve 100 is seated on or departs from the seat position.

A nozzle body processed by the method and apparatus of the embodiment will have concave portions 26 of very small depth in the conical seat face 23 in the nozzle body 20 in the range below the seat position indicated by the broken line as shown in FIGS. 8*a* and 8*b*, each of the concave portions 26 corresponding to the passage groove 31. Each of the concave portions 26 extends to the injection hole 24 with which the passage groove was communicated when performing abrasive fluid flowing processing.

In the case of processing the nozzle body by the method and apparatus of the embodiment, abrasive fluid is introduced to each injection hole 24 through the passage groove 31 and the entrance corner of the injection hole is ground by abrasive fluid concentrically at its corner connecting to the passage groove 31, so the entrance corner of the injection hole 24 is rounded large at one side and rounded small at the other side, and in actual operation of engines fuel tends to flow into each of the injection holes 24 via the entrance corner side rounded large. As a result, there occurs difference in fuel flow velocity between at the entrance corner rounded with a large radius and that rounded with a small radius, swirling flow is generated, and atomization of a larger angle of spray can be obtained.

Further, in the embodiment, as abrasive fluid flowing processing is performed for one injection hole at a time, only one processing end detection means is needed, and timing of stopping abrasive fluid flowing processing for all of the injection holes can be detected by one processing end detection means. In this case, it is also suitable to provide a means to rotate the mounting platform 10 to which the nozzle body 20 is fixed on the central axis of the passage 6 of the barrel 2 so that the fluid flowing out from one injection hole is received in the fluid receiver of the one processing end detection means every time abrasive fluid flowing processing for one injection hole is finished. Therefore, variation in accuracy of the processing end detection means does not occur, which may occur when plural injection holes are processed at the same time, and processing can be performed with higher accuracy.

While explanation has been done based on three embodiments, it is suitable to combine for example the second embodiment with the third embodiment such that an insert tool having one straight passage groove is used for processing injection holes one by one. It is suitable also to combine the third embodiment with the first and second embodiment such that an insert tool having a plurality of passage grooves each of which has a straight part and a curved part is used for processing all of the injection holes at the same time.

Further, when using an insert tool having a plurality of passage grooves, it is sufficient to use an insert tool that has passage grooves to correspond with injection holes, and shape of the grooves is not limited to be as described in the explanation of the first to third embodiments. Of course, the invention can be applied to the case of single injection hole.

According to the injection hole machining methods according to the first and second aspects of the invention and according to the injection hole machining apparatuses according to the seventh and eighth aspects of the invention, the injection hole side end part of the insert tool is shaped similar to that of the needle valve and the insert tool is retained at a position that the needle valve is lifted in actual operation of engines when abrasive fluid flowing processing is performed, abrasive fluid flows through a space very similar to that when fuel flows in actual operation of engines at least upstream of the injection holes. As a result, the entrance corner of each injection hole is rounded with a larger radius of curvature particularly in the upstream region of fuel flow than other regions, and a nozzle body claimed in claim 13 can be obtained. In actual operation of engines, a large part of fuel flows concentrically from the upstream side entrance corner into the injection hole, so it is very important to be able to round the upstream side entrance corner with a large radius curvature. That is, the entrance corner of the injection hole can be effectively rounded with a large radius of curvature in a region where flow resistance is large for fuel entering the injection hole, and occurrence of cavitation erosion due to occurrence of separation of fuel flow near the needle valve and injection holes is suppressed and variation in fuel injection characteristic is reduced.

According to the injection hole machining methods according to the third and fifth aspects of the invention and according to the injection hole machining apparatuses the ninth and eleventh aspects of the invention, abrasive fluid flows through the passage groove or grooves formed on the conical surface of the insert tool to the injection holes, the entrance corner of each of the injection holes is ground by abrasive fluid concentrically at its corner connecting to the passage groove or grooves, so the entrance corner of the injection hole is rounded large at one side and rounded small at the other side, concave portions of very small depth are formed on conical seat face in the nozzle body, and a nozzle body according to the fourteenth aspect of the invention can be obtained. In actual operation of engines, a large part of fuel flows concentrically from the upstream side entrance corner into the injection hole, so it is very important to be able to round the upstream side entrance corner with a large radius curvature. That is, the entrance corner of the injection hole can be effectively rounded with a large radius of curvature in a region where flow resistance is large for fuel entering the injection hole, and occurrence of cavitation erosion due to occurrence of separation of fuel flow near the needle valve and injection holes is suppressed.

Further, as abrasive fluid flows through the passage groove or grooves, concave portions of very small depth are formed in the conical seat face in the nozzle body extending downstream along generation lines of the conical seat face to the injection holes. That is, the concave portions are formed to reach the injection holes by the most direct way. Therefore, in actual operation of engines, fuel flows to the injection holes easier taking the shortest way, and it is advantageous for increased fuel flow through the injection holes.

According to the injection hole machining methods according to the fourth and sixth aspects of the invention and according to the injection hole machining apparatuses according to the tenth and twelfth aspects of the invention, concave portions of very small depth each of which consists of a straight part and a curved part continuing to the straight part are formed on the conical seat face in the nozzle body in the downstream range from seating position of the conical surface of the needle valve on the conical seat face in the nozzle body in actual operation of engines, and an injection nozzle according to the fifteenth aspect of the invention is obtained. When fuel flows in actual operation of engines, the fuel tends to flow swirling influenced by the concave portions to the injection holes, and atomization of a larger angle of spray can be obtained.

Further, according to the injection hole machining methods of according to the second through fourth aspects of the invention and according to the injection hole machining apparatuses according to the eighth through tenth aspects of the invention, abrasive fluid flowing processing is performed for plural injection holes concurrently while measuring mass flow rate or volume flow rate of abrasive fluid flowing through each of the injection holes independently, processing is stopped for any one of the injection holes when flow rate of abrasive fluid flowing through the relevant injection hole reaches a predetermined value by blocking the relevant injection hole, and processing finished when all of the injection holes are blocked.

By the way, abrasive fluid in the barrel of the abrasive fluid supply section is agitated enough to be homogeneous fluid, so volume flow rate can be converted to mass flow rate simply by multiplying density thereof.

According to the injection hole machining methods according to the fifth and sixth aspects of the invention and according to the injection hole machining apparatuses according to the eleventh and twelfth aspects of the invention, the injection holes are processed one by one, so only one processing end detection means is required. Therefore, flow rate of abrasive fluid flowing through each of the injection holes is measured by a single processing end detection means, and variation in flow rate measurement due to variation in accuracy of plural processing end detection means which may occur when performing processing of plural injection holes concurrently is eliminated. So, it is suitable to adopt a method and apparatus with which processing of injection holes is performed one by one when it is required to achieve equalization in flow characteristic rigorously, and to adopt a method and apparatus with which the processing of plural injection holes is performed concurrently and in shorter time period when requirement for exactness of equalization in flow characteristic is not so rigorous.

The invention claimed is:

1. A fuel injection nozzle, comprising:

a nozzle body having, a plurality of injection holes, each injection hole having an entrance corner rounded with a larger curvature radius in an upstream region of fuel flow than in regions other than the upstream region of fuel flow, a central hollow for accommodating a needle valve, and a tapered seat face formed in the central hollow at a forefront part of the nozzle body, wherein the tapered seat face has said plurality of injection holes in a circumferential direction thereon, and wherein the nozzle body further includes, substantially straight concave portions formed on the tapered seat face and extend along generation lines of the tapered seat face.

2. A fuel injection nozzle, comprising:

a nozzle body having, a plurality of injection holes, each injection hole having an entrance corner rounded with a larger curvature radius in an upstream region of fuel flow than in regions other than the upstream region of the fuel flow, a central hollow for accommodating a needle valve, and a tapered seat face formed in the central hollow at a forefront part of the nozzle body, wherein the tapered seat face has said plurality of injection holes in a circumferential direction thereon, wherein the nozzle body further includes, concave portions formed on the tapered seat face, the number of the concave portions being the same as that of said plurality of injection holes, each of the concave portions having a substantially straight part extending along generation lines of the tapered seat face in the nozzle body and a curved part continuing to the substantially straight part, and wherein the entrance corner of each injection hole is rounded with a larger curvature radius in a region continuing to the concave portion than in regions other than the region continuing to the concave portion.

* * * * *